United States Patent [19]

Holdsworth

[11] 4,357,759

[45] Nov. 9, 1982

[54] METHOD OF REMOVING WATER FROM WATER BASE CAN SEALANT

[75] Inventor: Robert S. Holdsworth, Arlington, Mass.

[73] Assignee: W. R. Grace & Co., Cambridge, Mass.

[21] Appl. No.: 231,185

[22] Filed: Feb. 3, 1981

[51] Int. Cl.[3] ..... F26B 5/16

[52] U.S. Cl. ..... 34/9; 34/38; 34/95; 413/59; 118/58; 427/372.2

[58] Field of Search ..... 113/121 A, 80 D, 80 DA; 427/372.2; 118/58; 15/210; 34/6, 9, 38, 94, 95

[56] References Cited

U.S. PATENT DOCUMENTS 1,192,705 7/1916 Taliaferro et al. ..... 193/38

2,392,238 1/1946 Fankhanel ..... 113/80 DA

FOREIGN PATENT DOCUMENTS 476426 11/1975 U.S.S.R. ..... 34/89.1

*Primary Examiner*—Larry I. Schwartz

*Attorney, Agent, or Firm*—Edward J. Hanson, Jr.; William L. Baker

[57] ABSTRACT

A method for removing water from water base can end lining compound after application without the use of a dryer. The method comprises the steps of arranging the lined can ends in a stack, wrapping the stacked can ends in a suitable absorbent material, and allowing the absorbent material to remove the water from the compound by absorption.

22 Claims, 3 Drawing Figures

METHOD OF REMOVING WATER FROM WATER BASE CAN SEALANT

BACKGROUND OF THE INVENTION

This invention relates to the field of can end lining compounds, and, more particularly, to a method of removing water from water base can end lining compounds after the can ends have been lined.

The art of container sealing has an established terminology which will be used in this specification. The walls of the container are known as the "body". The end closures are known as "ends". The gasket which is interposed between the ends and body and is responsible for the hermetic or liquid-tight seal between the parts is known as the "lining". The plastic or liquid composition which, upon cooling or drying, forms the solid gasket, is known as "lining".

The body of the can is a cylindrical piece of sheet metal normally made by forming a rectangular piece of metal and then joining the ends of the rectangle along the side seam. The metal in the ends of the cylinder are flanged outwardly. The can is completed by placing a circular piece of metal called the "end" over each end of the cylinder and rolling the outer edge of the end and flange on the body together in a double seam. That portion of the end which covers the interior of the can is called the "panel". The outer periphery of the end is formed into a circular depression called the "channel" which cooperates with the flange on either end of the body. The outer edge of the channel called the "curl" is deformed upwardly and inwardly to provide contact of the can end with the inner side of the flange of the can body during the first stage of the double seaming operation. The inner wall of the channel, i.e., the portion between the channel and the panel, is known as the "shoulder". The plastic or liquid composition which forms the "lining" is placed in the channel of the can end.

Sealing compounds for can covers ("ends") are commonly applied to the covers in liquid form. The machines, called "lining machines", which apply the compound to the joint area, have, as essential operating elements, a continuously rotating chuck which receives and rotates the end, a "nozzle", essentially a squirt gun, controlled by a needle valve which projects the compound downwardly onto the joint area of the end, and a quick opening and closing cam which lifts the needle valve and closes it at the proper instant. Through the operation of the lining machine, a ring of fluid compound is formed on the joint area adjacent the periphery of the end. This ring of compound, whether in liquid form or later when it is dried, or fluxed into a solid mass is called the "lining". Its function is to form the gasket between the can parts and hermetically seal the can.

A common type of compound-applying ("lining") machine removes a blank end from a stack; slides the end along a table; places it on a continuously revolving chuck, where the compound is applied and placed; pushes the end from the chuck; tucks it beneath a stack of finished ends; and places a new end on the chuck in a single cycle of operation. After the can ends have been lined, they are conveyed to an area where the volatile components of the lining composition are removed.

Ballou, et al, U.S. Pat. No. 3,013,896 and Flaherty, U.S. Pat. No. 3,310,196 describe the basic operations employed in lining can ends and attaching the can ends to the can body. These references are incorporated by reference in this application to the extent not provided for herein.

Water base can end lining compounds are water dispersions of special rubbers which, when flowed into can ends and dried, provide an hermetic seal. The solids portion of a water base can end lining compound ranges from about 40 percent to about 75 percent of the total composition. The water portion of the compound ranges from 25 percent to 60 percent of the total composition. Based upon 100 parts per hundred of rubber (hereinafter referred to as phr), the solids portion of a typical water base lining compound has the following composition (all parts are expressed in weight):

| Ingredient | Amount |
|---|---|
| Rubber | 100 phr |
| Pigment and/or filler | 50–200 phr |
| Resin | 0–100 phr |
| Antioxidant | less than 1% |
| Bacteriocide | less than 1% |
| Surface Active Agents | 0.5% to 10% |

The conventional method of drying the water base compounds involves the use of an oven dryer.

Water base compounds must be thoroughly dried in the can end after being applied, or squeezing may result if the ends are double seamed before the compound is completely dry. Temperature and time of drying are variable depending upon the type of dryer and arrangement of the can ends in the dryer. When the can ends are stacked on top of one another and placed in an oven in stacks, usually a 20-minute cycle at 200° F. to 250° F. will give best results. When the lined can ends are dried in a helical stacker oven wherein they are separated from one another, 8–10 minutes at 190° F. to 210° F. is usually sufficient. The most efficient dryers are gas or electric-fired, forced draft ovens which employ the principle of recirculating air.

A 24–48 hour aging period is advised for lined ends in order for the compounds to establish a moisture equilibrium and to insure best performance. This also allows for adjustment in rheological properties due to the drastic change from dispersion to solidified gasket material.

A serious problem with the conventional drying method is that numerous can makers do not possess the facilities for setting up oven driers of sufficient capacity to be economically feasible. This problem came about because can makers generally preferred to use solvent base can end lining compounds. Solvent base can end lining compounds are primarily solvent solutions of special rubber. Ends lined with solvent base compounds can be dried without heat, but should be dried in an area where there is a good air circulating and exhaust system.

Because of increased awareness of health problems which may be due in part to organic solvents which originate from can end lining compounds, can makers and canners now prefer to employ water base can sealing compounds. The problem of removal of water from the applied compound without the use of oven dryers must now be addressed.

To achieve commercial acceptance, an "air dry" waterbase can sealing compound must dry (i.e., be seamable) within a maximum of 24 hours after lining onto can ends under a wide range of ambient atmospheric conditions. The sealing compounds which have been formulated to date are generally lined at 60%–75% total solids (by weight) and must be dried to approximately 97% total solids (by weight) before they can be subjected to double seaming without squeezing out of the seam. Even allowing for technical progress in formulating compounds which can be lined at higher total solids and/or exhibit increased squeeze resistance at lower total solids, it is expected that waterbase compounds will have a considerable amount of water to be evaporated within the 24 hour time period.

Accordingly, it is an object of this invention to provide a method for removal of water from water base can end lining compounds after application without the use of an oven dryer or other source of heat.

It is another object of this invention to reduce the energy requirements of the process employed in lining can ends with water base can end lining compounds.

SUMMARY OF THE INVENTION

This invention involves a method for removal of water from water base can end lining compounds after the lining is applied without the necessity for increasing the heat of the environment where the can ends are dried and/or stored.

The method comprises the steps of applying the can end lining compound to the joint area of the closure, arranging the can ends in stacks after the lining compound has been applied, and then enveloping the stack of lined can ends in a water absorbent material of sufficient capacity to remove at least 85 percent of the water from the applied can end lining compound.

DETAILED DESCRIPTION OF THE INVENTION

Figure 1:
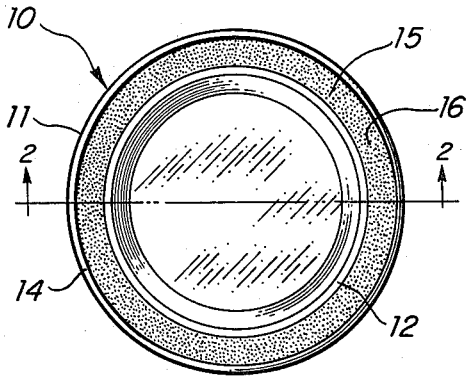
FIG. 1 is a plan view of a typical can end.
Figure 2:
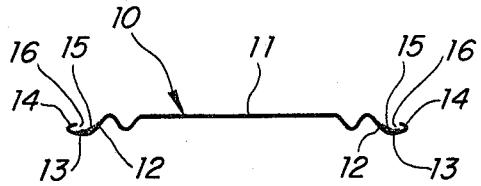
FIG. 2 is a cross-sectional view taken along line 2—2 of the can end in FIG. 1.

Referring now to FIGS. 1 and 2, the can ends 10 which are subject to the process of this invention are made in a separate operation by stamping a blank from material which may be tin plate, black plate, aluminum or other sheet metal. In general, the blank is stamped into the desired configuration, e.g., circular, oval, or rectangular, depending upon the configuration of the can body, and is formed with a countersunk panel 11 which merges into a substantially vertical surrounding wall section 12. The outer edges of the wall section 12 merge into a substantially horizontal annular flange 13 which terminates in an inwardly curled edge 14. A flowable water base lining composition 15 is applied to the under surface of the annular horizontal flange 13 within the annular channel 16 defined by the vertical wall section 12 and edge curl 14. The compound 15 is usually deposited in the channel 16 using conventional nozzle lining machinery but may be applied in any other suitable and convenient manner. It may be observed in FIGS. 1 and 2 that the compound 15 does not come to the edge of the can end.

A typical lining machine is described in Alholm, U.S. Pat. No. 3,220,381, issued Nov. 30, 1965 which is incorporated herein by reference.

Figure 3:
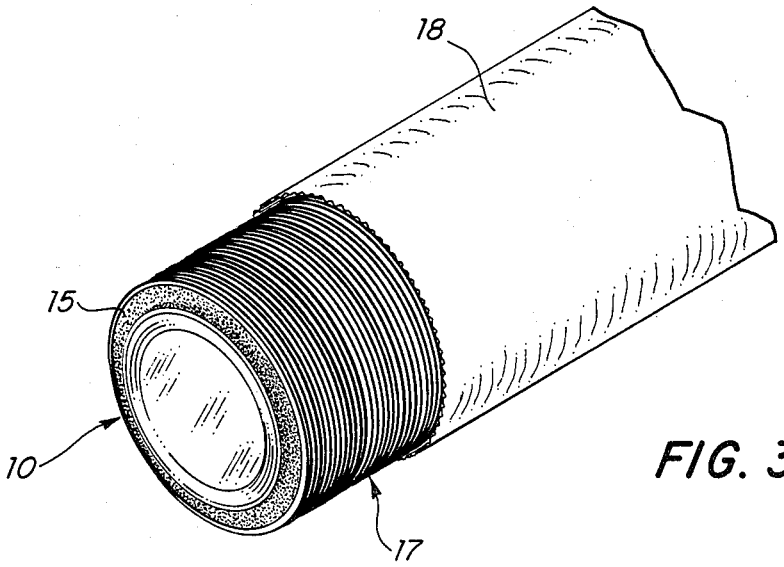
FIG. 3 is a perspective view of a stack of can ends enclosed in water absorbent material.

The newly lined can ends are then arranged in a stack 17. The stack 17 generally contains between about 250 and about 450 can ends. However, the precise number of can ends in the stack 17 is not critical. The can end lining compound may contain about 25% to about 60% moisture after application. Before the stack is placed on a pallet to dry, it is enclosed within a water absorbent material 18. As is apparent from FIGS. 1, 2, and 3 the absorbent material 18 would not be in contact with the water base can end lining compound on a can end interior of a stack. The end of the sleeve of absorbent material 18 could, of course, come in contact with the lining compound on the can end at the bottom of the stack 17 in FIG. 3.

The environmental conditions of the drying area dictate the precise parameters for the absorbent material 18. The parameters to be considered are: (1) The type of absorbent material; (2) the physical form of the absorbent material; and (3) the weight per unit of length of the absorbent material. Because the absorbent material is generally of uniform density, the weight per unit of length is generally directly proportional to the thickness of the material.

Suitable water absorbent materials 18 include various types of paper, wood, and rayon. The types of paper which are useful for absorption of water include kraft, newsprint, and cardboard. In general, water absorbent materials produced from a cellulose based material are acceptable. Silica gel is also suitable as a water absorbent material.

When paper is employed as the absorbent material, it can be employed in the form of sleeves, snake wrap, or boxes (e.g., cardboard boxes).

I have discovered that weight per unit of length is a critical factor in selection of an effective water absorbent material under conventional manufacturing conditions. This factor is critical because the absorbent material must not become saturated with moisture before a sufficient amount of moisture is removed from the can end lining compound.

The following examples illustrate but are not limitative of the invention. All such variations which do not depart from the basic concept of the invention disclosed above are intended to come within the scope of the appended claims.

EXAMPLE A

Can ends lined with a typical water base can end lining compound were arranged in stacks of 40 can ends each. The height of each stack was approximately 95 mm. The diameter of each can end was 73 mm. The lining compound contained the following components in the amounts indicated (all parts are expressed in weight):

Solids Portion (73 percent of total composition)
100 parts rubber
200 parts pigment and/or filler
1 part antioxidant
1 part bacteriocide
6 parts rust inhibitor
10 parts surfactants, thickeners
Liquid Portion (27 percent of total composition)
100 parts water Each lined can end contained approximately 40 $mm^3$ of wet lining compound. The specific gravity of the lining compound was 1.63. Therefore, the weight of the wet lining compound per can end was about 90 mg. The weight of the solids portion of the lining compound per can end was about 65 mg.

Three of the stacks of 40 lined can ends were then enclosed or covered with with a sleeve made of paper (see Examples I, II, III). Two of the stacks of lined can ends were left uncovered (see Examples IV, V). Each stack of 40 lined can ends was then placed in a cylindrical metal container having an inside diameter of 87 mm and a length of 111 mm. No more than one stack was placed in the cylindrical container at any given time. The container was then sealed. The sealed cylindrical metal container served the function of simulating the conditions existing in the interior of a pallet of freshly lined can ends where the lined can ends are not exposed to air currents, and the evaporation of water into the outside air is inhibited by all of the other can ends. The relative humidity of this environment was approximately 100%. The container was not only impermeable to the atmosphere, but the material forming the container was also incapable of absorbing water. Under these conditions, one would not expect the moisture present in the can end lining compound to evaporate or be removed in some other manner from the lining compound.

Each stack was allowed to remain in the sealed cylindrical container for a period of 24 hours. At the end of that period, the moisture content of the lining compound was measured.

The following examples set forth in greater detail the treatment given to each of the five stacks of lined can ends after the lining step and before the stacks are sealed in the cylindrical metal container.

EXAMPLE I

A first stack of 40 lined can ends from Example A was enclosed or covered with a single sleeve made of kraft paper. This paper had a moisture content of approximately 7 percent. The weight per unit of length of this sleeve was 0.03 g/mm (the weight of a sleeve having a length of 127 mm was approximately 4 g).

Example II

A second stack of 40 lined can ends from Example A was enclosed or covered with one sleeve made of kraft paper. This paper had a moisture content of approximately 0 percent. The weight per unit of length of these sleeves was 0.03 g/mm (the weight of a sleeve having a length of 127 mm was approximately 4 g).

EXAMPLE III

A third stack of 40 lined can ends from Example A was enclosed or covered with three sleeves made of Kraft paper. This paper had a moisture content of approximately 0 percent. The weight per unit of length of these sleeve was 0.09 g/mm (the weight of a single sleeve having a length of 127 mm was approximately 4 g).

EXAMPLE IV

A fourth stack of 40 lined can ends from Example A was left uncovered.

EXAMPLE V

A fifth stack of 40 lined can ends from Example A was left uncovered. However, a strip of wood in the form of a tongue depressor was inserted into the cylindrical container along with the fifth stack of lined can ends. The total weight of the wood strip was 8 g.

The following table sets forth the results of the experimental procedure:

TABLE I*

| EXAMPLE NO. | COMPOSITION OF CAN END LINING COMPOUND | | ABSORBENT MATERIAL | WEIGHT PER UNIT LENGTH OF ABSORBENT MATERIAL (g/mm) | INITIAL MOISTURE CONTENT OF ABSORBENT MATERIAL % | DRYING TIME (Hours) | COMPOSITION OF CAN END LINING COMPOUND AFTER DRYING | |
|---|---|---|---|---|---|---|---|---|
| | % Nonvolatives | % Water | | | | | % Nonvolatives | % Water |
| 1 | 73 | 27 | Paper | 0.03 | 7 | 24 | 91 | 9 |
| 2 | 73 | 27 | Paper | 0.03 | 0 | 24 | 94 | 6 |
| 3 | 73 | 27 | Paper | 0.09 | 0 | 24 | 99 | 1 |
| 4 | 73 | 27 | None | N/A | N/A | 24 | 77 | 23 |
| 5 | 73 | 27 | Wood Strip | —** | 7 | 24 | 98 | 2 |

*All percentages are expressed in weight.
**The total weight of the wood strip was 8 g.

From the foregoing table, it can be seen that the most effective drying occurred when three dry paper sleeves (0 percent moisture content) were employed to absorb the moisture from the can end lining compound which had been applied to the can ends. The weight per unit of length was approximately 0.09 g/mm.

What is claimed is:

1. In the process for lining can ends with a water base can end lining compound wherein the can ends are
(1) introduced to a lining machine
(2) lined
(3) removed from the lining machine
(4) arranged in stacks
(5) allowed to dry
the improvement which comprises enclosing the arranged stacked can ends in water absorbent material that does not come in contact with the water base can end lining compound on can ends interior of a stack, prior to any other substantive drying step whereby the need for an external source of heat for the purpose of drying is eliminated.

2. The process of claim 1 wherein the water absorbent material is derived from a cellulose based material.

3. The process of claim 1 wherein the water absorbent material is paper.

4. The process of claim 3 wherein the paper is selected from the group consisting of kraft, newsprint, and cardboard.

5. The process of claim 3 wherein the paper has a weight per unit of length of at least 0.03 g/mm.

6. The process of claim 1 wherein the water absorbent material is wood.

7. the process of claim 1 wherein the water absorbent material is rayon.

8. A method of removing water from water base can end lining compound after the compound has been applied to a plurality of can ends comprising the steps of
(a) arranging the can ends in a stacked formation wherein the panel of a given can end is in contact with the panel of the can end which is adjacent to it, (b) enclosing said arranged can ends with a water absorbent material before said water has been substantially reduced in said water base can end lining compound and maintaining said water absorbent material out of contact with the water base can end lining compound on can ends interior of a stack.

9. The method of claim 8 wherein the water absorbent material is allowed to remain on the arranged can ends for a period of time so that about 85 percent to about 97 percent of the water present in the lining compound is absorbed.

10. The process of claim 8 wherein the water absorbent material is derived from a cellulose based material.

11. The process of claim 8 wherein the water absorbent material is paper.

12. The process of claim 11 wherein the paper is selected from the group consisting of kraft, newsprint, and cardboard.

13. The process of claim 11 wherein the paper has a weight per unit of length of at least 0.03 g/mm.

14. The process of claim 8 wherein the water absorbent material is wood.

15. The process of claim 8 wherein the water absorbent material is rayon.

16. A method of removing water from water base can end lining compound after the lining compound has been applied to a plurality of can ends and without employing an external source of heat or dehumidification comprising the steps of (a) arranging the lined can ends in a stack (b) covering the stacked can ends with a material which is capable of irreversibly absorbing 85 percent to 97 percent of the water initially present in the can end lining compound (c) placing said covered stacked can ends on a pellet (d) allowing the covering material to remain on said stacked can ends for a period of time sufficient to insure adequate drying while maintaining said covering material out of contact with the water base can end lining compound on can ends interior of the stack.

17. The process of claim 16 wherein the water absorbent material is derived from a cellulose based material.

18. The process of claim 16 wherein the water absorbent material is paper.

19. The process of claim 18 wherein the paper is selected from the group consisting of kraft, newsprint, and cardboard.

20. The process of claim 18 wherein the paper has a weight per unit of length of at least 0.03 g/mm.

21. The process of claim 16 wherein the water absorbent material is wood.

22. The process of claim 16 wherein the water absorbent material is rayon.

* * * * *